United States Patent [19]

Jones

[11] Patent Number: 4,635,814

[45] Date of Patent: Jan. 13, 1987

[54] LINED RECEPTACLES

[75] Inventor: Allen S. Jones, Lynfield, New Zealand

[73] Assignee: Rheem Manufacturing Company, New York, N.Y.

[21] Appl. No.: 704,144

[22] Filed: Feb. 21, 1985

Related U.S. Application Data

[63] Continuation of Ser. No. 533,001, Sep. 16, 1983, abandoned.

[51] Int. Cl.[4] ..... B65D 25/16

[52] U.S. Cl. ..... 220/403; 220/85 B; 220/367; 220/461; 220/465; 220/466; 383/41; 383/107; 383/109

[58] Field of Search ..... 220/465, 466, 460, 461, 220/85 B, 403, 367; 383/109, 121, 41, 107

[56] References Cited

U.S. PATENT DOCUMENTS

| | | | |
|---|---|---|---|
| 2,564,163 | 8/1951 | LePerre | 217/3 CB X |
| 2,721,674 | 10/1955 | Lazard | 220/465 X |
| 2,999,500 | 9/1961 | Schurer | 220/85 B |
| 3,357,152 | 12/1967 | Geigel | 383/121 X |
| 3,381,886 | 5/1968 | Goglio | 383/121 |
| 3,432,070 | 3/1969 | Carpenter, Jr. et al. | 220/465 X |
| 3,437,231 | 4/1969 | Carpenter, Jr. | 220/465 |
| 3,448,889 | 6/1969 | Malpas | 220/461 |
| 3,454,211 | 7/1969 | Hoffman | 383/121 X |
| 3,724,712 | 4/1973 | Starr et al. | 220/461 |
| 3,930,286 | 1/1976 | McGowen | 220/465 X |
| 4,202,463 | 5/1980 | Mogler | 217/110 X |

FOREIGN PATENT DOCUMENTS

| | | | |
|---|---|---|---|
| 491902 | 3/1954 | Italy | 220/461 |
| 666194 | 4/1961 | Italy | 220/85 B |
| 403528 | 6/1966 | Switzerland | 217/3 CB |
| 430256 | 6/1935 | United Kingdom . | |
| 648863 | 1/1951 | United Kingdom . | |
| 699799 | 11/1953 | United Kingdom . | |
| 992182 | 5/1965 | United Kingdom . | |
| 1000634 | 8/1965 | United Kingdom . | |
| 1032701 | 6/1966 | United Kingdom . | |
| 1190593 | 5/1970 | United Kingdom . | |
| 1273495 | 5/1972 | United Kingdom . | |
| 1392603 | 4/1975 | United Kingdom . | |
| 1444028 | 7/1976 | United Kingdom . | |
| 2012737 | 8/1979 | United Kingdom . | |

*Primary Examiner*—Allan N. Shoap

*Attorney, Agent, or Firm*—Allegretti, Newitt, Witcoff & McAndrews, Ltd.

[57] ABSTRACT

A flexible bag-like liner having a relatively thin wall is adapted to be connected to a wall portion of a receptacle with a liquid passageway provided in association with the wall portion so that liquid may be introduced into the liner and discharged therefrom; the wall portion is adapted to be fitted substantially in sealing relationship with a body portion of the receptacle with discharge means being provided for discharging air from between the liner and the interior walls of the receptacle when fluid under pressure is introduced into the liner to urge the liner against the interior walls of the receptacle. The arrangement is such that when the contents of the liner are partially discharged, a partial vacuum between the exterior of the liner and the interior of the receptacle urges the liner into contact with interior walls of the receptacle.

3 Claims, 6 Drawing Figures

LINED RECEPTACLES

This application is a continuation, of application Ser. No. 533,001, filed Sept. 16, 1983, now abandoned.

FIELD OF THE INVENTION

The present invention relates to lining arrangements for receptacles such as cylindrical steel drums or barrels or other containers for liquids or particulate materials.

BACKGROUND TO THE INVENTION

Cylindrical steel drums conventionally have end walls sealingly fixed to a cylindrical side wall with flanges provided in one of the end walls receiving screw plugs so that the contents may be filled and discharged through the flanged openings. For many products a lining such as a plastic-type lining is required to protect the structure of the drum from contacting the contents. One known method of applying a suitable inert coating to the interior of such a drum is to melt a plastic coating onto the interior surfaces of the drum while rotating the drum at elevated temperature, a particulate supply of material for forming the plastic coating being first inserted into the drum.

Another approach has been to manufacture blow-moulded free-standing plastics liners which are placed inside the drum during its assembly and before the drum is shipped to the customer. Such liners, however, are expensive and a problem has existed with respect to the replacement of the liner when the drum is reconditioned. Since the liners are blow-moulded free-standing liners, the wall thickness is relatively large and rigid and thus transportation and storage of these liners is very expensive.

With this problem in mind, it has also been proposed to manufacture a liner which, although being relatively heavy and having a substantial wall thickness, is designed to be foldable to reduce storage and transportation volume. However, such liners have creases at the folds and these creases are difficult to remove and may initiate premature failure of the liner.

The limitations of the previous proposals are such that new and useful alternatives would be desirable.

SUMMARY OF THE INVENTION

According to a first aspect of the present invention there is provided, in combination, a wall portion for a closed receptacle adapted to be secured in sealed relationship with a body portion of said receptacle, a flexible liner for lining the interior surfaces of said closed receptacle and adapted to prevent contents of the receptacle directly contacting its interior surfaces, the flexible liner and said wall portion being interconnected and there being provided at least one closable fluid passageway communicating the interior of the liner with the exterior of the wall portion, and air discharge means associated with said wall portion and adapted, after assembly of the closed receptacle, to discharge air from between the liner and the interior of the closed receptacle when fluid is introduced into the liner to expand the liner against the interior walls of the receptacle, the air discharge means being adapted to prevent ingress of air when contents of the lined receptacle are discharged, whereby the liner is urged into contact with interior surfaces of the receptacle.

One important application of the invention is to the case where the receptacle is a cylindrical drum and the wall portion to which the liner is attached is an end wall of the drum, the end wall usually being interconnected with the end of the side wall in any convenient way such as by a clinching or seaming operation in which a seal is established, or by an exterior clamping technique in which the end wall fits over a rim at the top of the side wall and a suitable clamp is tightened preferably with sealing material being provided between the contacting parts.

The invention extends to the combination of the wall portion and interconnected flexible liner installed within the body portion to form a lined, closed receptacle; in general, the air discharge means may be associated with any wall of the receptacle.

In one important application of the invention, when the invention is embodied in a closed receptacle, the body portion of the closed receptacle is formed by a cylindrical side wall and a sealed end wall which is adapted for insertion in and securement to one end of the side wall, the wall portion and attached flexible liner being fitted to the other end of the side wall with the wall portion being adapted for insertion in and securement to the other end of the side wall.

Preferably, the or each closable fluid passageway is provided by a gland of suitable material interconnected with the flexible liner and the gland is secured in an aperture in the wall portion thereby interconnecting the flexible liner and wall portion.

Most preferably the gland is a plastic moulding having a reduced external diameter neck portion extending away from the flexible liner to an enlarged head and the wall portion has its aperture provided by an outwardly projecting substantially cylindrical skirt-like structure of axial length corresponding to that of the neck of the gland, the neck of the gland being fitted by snap action by being pressed through the aperture whereby the peripheral tip of the skirt engages under the head of the gland.

The gland may have an internal screw-thread in the neck for receiving a closure plug or other fitting, and especially in this embodiment a torque resisting element should be associated with the gland. Most preferably torque resistance is provided by a projection extending from a base portion of the gland in the same direction as said neck, the wall portion having a corresponding recess or aperture for receiving the projection.

Very advantageously, two such glands are provided and interconnected with the wall portion on opposite sides thereof, one gland being adapted to be opened to permit ingress of air within the liner whilst the contents are discharged through the other gland.

It will be appreciated that the material forming the flexible liner can be chosen to suit the intended contents and the material could be simply a film of plastics material, a single or multi-ply structure and indeed could be a laminate. One important application of the invention is to the case where the liner is of a laminate about 125 microns thick with an interior layer of highly flexible relatively inert plastics material (such as polyethylene) and an exterior layer of a relatively tough and durable material (such as nylon). For example, a polyethylene interior layer of about 100 microns may be used with advantage together with an exterior nylon layer of about 25 microns thickness.

However, many other structures may be advantageous for particular applications.

One highly effective form for the air discharge means is a screw-threaded aperture provided in the wall portion and adapted to be closed by a screw-plug having sealing engagement.

According to a second aspect of the invention there is provided a method of forming a lined receptacle comprising taking a wall portion for the receptacle and connecting it to a body portion of the receptacle in a substantially sealed arrangement thereby forming a closed receptacle, said wall portion having attached thereto a flexible liner for lining the interior surfaces of the closed receptacle with at least one closable fluid passageway communicating the interior of the liner to the exterior of the wall portion and air discharge means being associated with the receptacle, applying fluid under pressure into the liner and discharging air from between the liner and the interior of the receptacle through said air discharge means thereby pressing the liner against the interior walls of the receptacle and substantailly preventing return of air between the liner and said interior walls of the receptacle whereby when the receptacle is in use and contents are discharged from the liner, the liner remains urged against said interior walls of the receptacle.

Conveniently, a compressed gas such as air can be used to inflate the bag and thereby expel the air from the space between the liner and the interior walls of the receptacle.

The invention can be most advantageously and economically implemented by the use of a thin-walled liner and, furthermore, for a given receptacle design, a range of liners suitable for different products can readily be provided. Furthermore, the nature of the liner permits a compact liner to be provided for storage and transportation purposes, yet a highly effective and reliable product can be achieved. By virtue of the combination of features according to the invention an effective and economic result can be achieved, the walls of the receptacle providing structural characteristics with the liner acting as a reliable barrier. By virture of the liner being held in substantially intimate contact over the interior walls of the receptacle, the risk of liner damage due to relative movement between it and the interior walls is minimized.

Furthermore, when it is desirable to recondition a drum it can be relatively simple process to fit a replacement liner after the receptacle has been opened by removal of the wall portion from the body portion.

BRIEF DESCRIPTION OF THE DRAWINGS

For illustrative purposes only, examples of the invention will now be described with reference to the accompanying drawings of which.

DETAILED DESCRIPTION OF THE DRAWINGS

Figure 1:
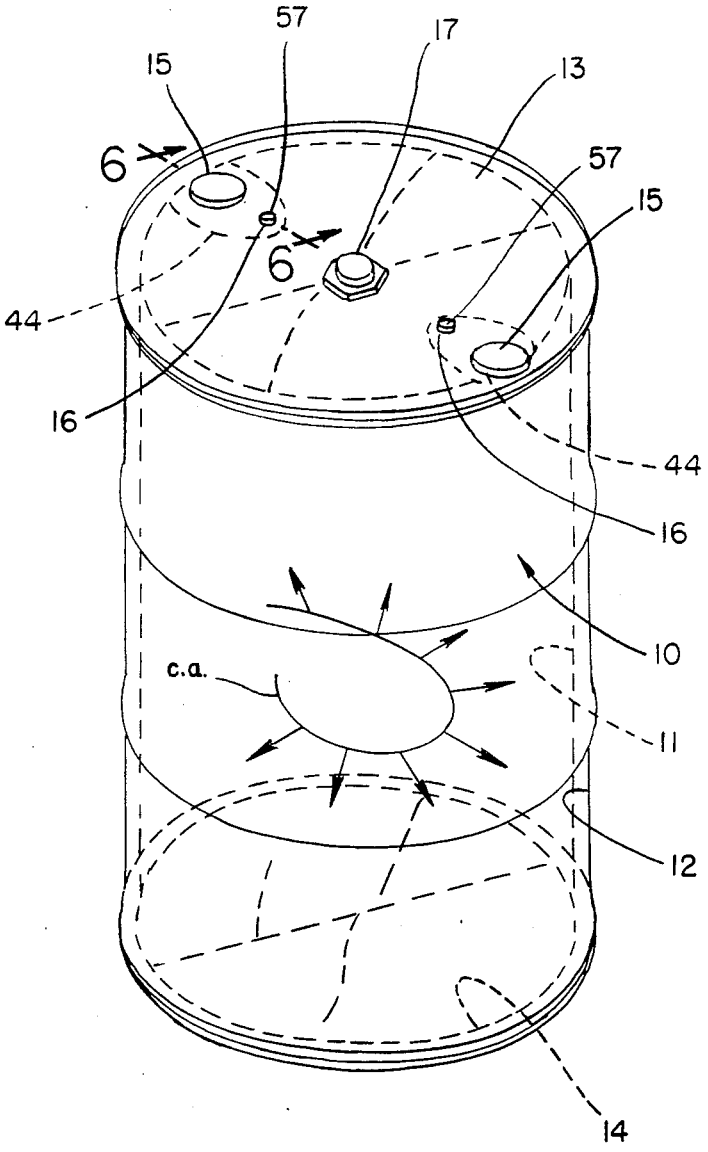
FIG. 1 is a perspective view of a receptacle with liner in accordance with a first embodiment of the invention.
Figure 2:
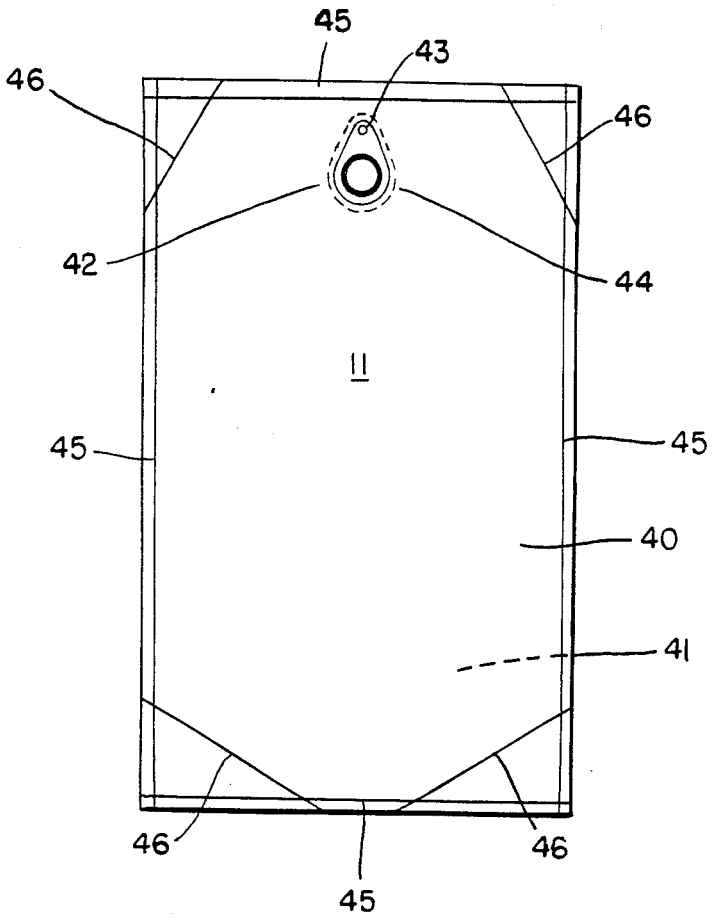
FIG. 2 is an elevational view of the liner used in FIG. 1 but shown on a reduced scale.
Figure 3:
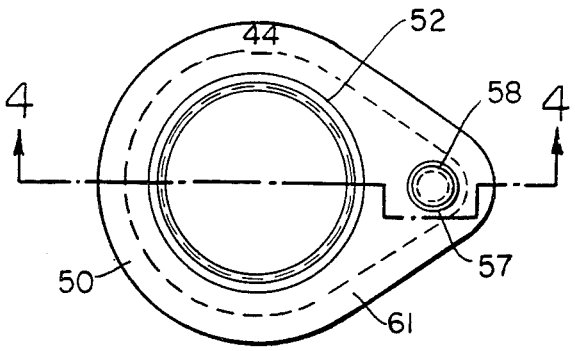
FIG. 3 is a plan view of a gland for the liner of FIG. 2 but to an enlarged scale.
Figure 4:
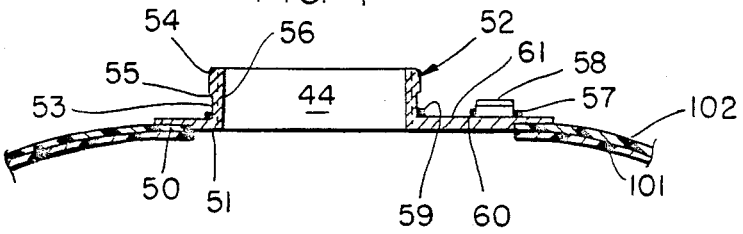
FIG. 4 is a cross-sectional view on the line 4—4 of FIG. 3.

FIG. 1 shows a receptacle in the form of a cylindrical steel drum (10) having installed therein a flexible plastic liner shown in more detail in FIG. 2 and secured to a top end wall (13) of the drum by two plastic glands (44) shown in more details in FIGS. 3 and 4. The drum (10) is of conventional form and has a sheet metal side wall (12) having at each end an outwardly directed bead with which the top and bottom end walls (13 and 14) are interconnected by a sealed seam effected by rolling.

On diametrically opposite sides of the top end wall, there are a pair of large openings (15) and small openings (16) respectively provided by axially outwardly directed skirts having a sharp shoulder with which the glands (44) are fitted as described in more detail below. Centrally located in the top end wall (13) is a venting opening (17) fitted with a screw-threaded flange for accommodating a screw-threaded sealing plug which is not shown in the drawing. The flange has a polygonal shoulder accommodated in a corresponding shaped interior recess in the end wall for providing torque resistance.

The liner (11) shown in detail in FIG. 2 is of bag-like form and is illustrated when laid out flat and viewed in elevation, the respective sides being similar and comprising front and back panels (40,41) having respective apertures around which a respective gland (44) is attached as described below, the panels being heat sealed together along their respective edges (45). Furthermore, to facilitate discharge of liquids from the liner when installed in a drum, liquids are preventing from reaching the corners of the bag-like structure by provision of subsidiary heat seals (46) directed across the corners of the bag.

The panels (40,41) can be of any suitable material which may be plastic film (either single ply or multi-ply structure) or if desired may be of or include laminated materials. For example, good results have been obtained from the use of a single ply laminated sheet of about 125 microns thickness with the inner layer 101 in FIG. 4 of the panel being polyethylene about 100 microns thick and the outer layer 102 in FIG. 4 being about 25 microns thick and of nylon. Another useful structure is obtained by a laminate having an interior layer of polyethylene film of about 50 microns thick and the outer layer itself being a laminate about 75 microns thick. This outer layer can be a laminate structure having the layer directed towards the inner layer of the panel being of polyethylene and about 50 microns thick whereas the outer layer of this laminate facing the exterior of the liner being about 25 microns thick and of the nylon.

Referring now to FIGS. 3 and 4, each gland (44) is an injection moulded component of thermoplastic material such as polyethylene and has a pear-shaped base (51) from which a pear-shaped outwardly directed flange (50) projects so that a portion of the panel (40 or 41) surrounding its opening may be welded to the underside of the flange (50).

Figure 6:
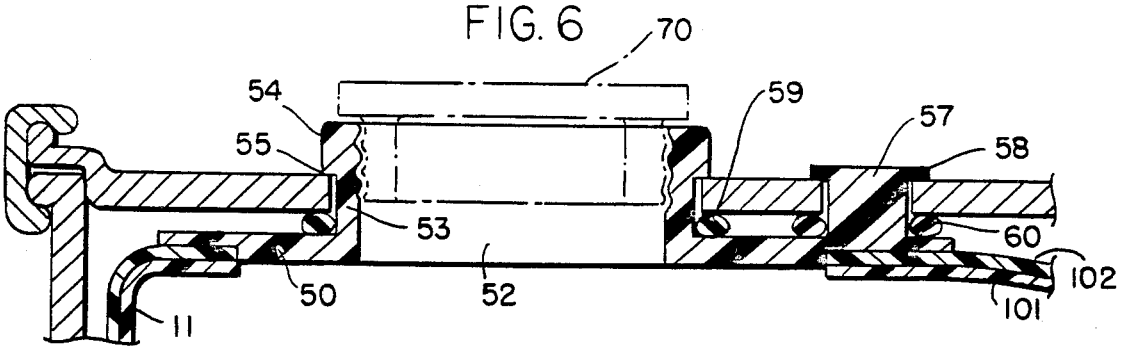
FIG. 6 is an enlarged cross-sectional view on the line 6—6 of FIG. 1.

An upstanding internally screw-threaded cylindrical projection (52) extends from the base (51) and has a reduced diameter neck (53) terminating in a shoulder (55) and leaving a larger diameter head (54). This cylindrical projection can be fitted with a screw plug (70), shown in phantom in FIG. 6, to close the bag and particulate or liquid material can be introduced into the bag or discharged therefrom readily.

A relatively small diameter upstanding spiggot (57) also extends from the base (51) and is hollow but is integrally formed with a top cap (58) which provides an outwardly directed enlarged head of the spiggot. The spiggot (57) and the cylindrical projection (52) carry respective O-ring seals (60 and 59) and each gland (44) is fitted and secured to the top end wall (33) by snap-fitting respectively the projection (52) and spiggot (57) through the openings (15 and 16). The upstanding skirt defining these opening snap-fits over the head (54) of the projection (52) and over the top cap (58) of the spiggot (57) to engage tightly and establish a seal. The spiggot (57) was a torque resisting function when a screw plug is inserted or removed from the cylindrical projection (52).

Figure 5:
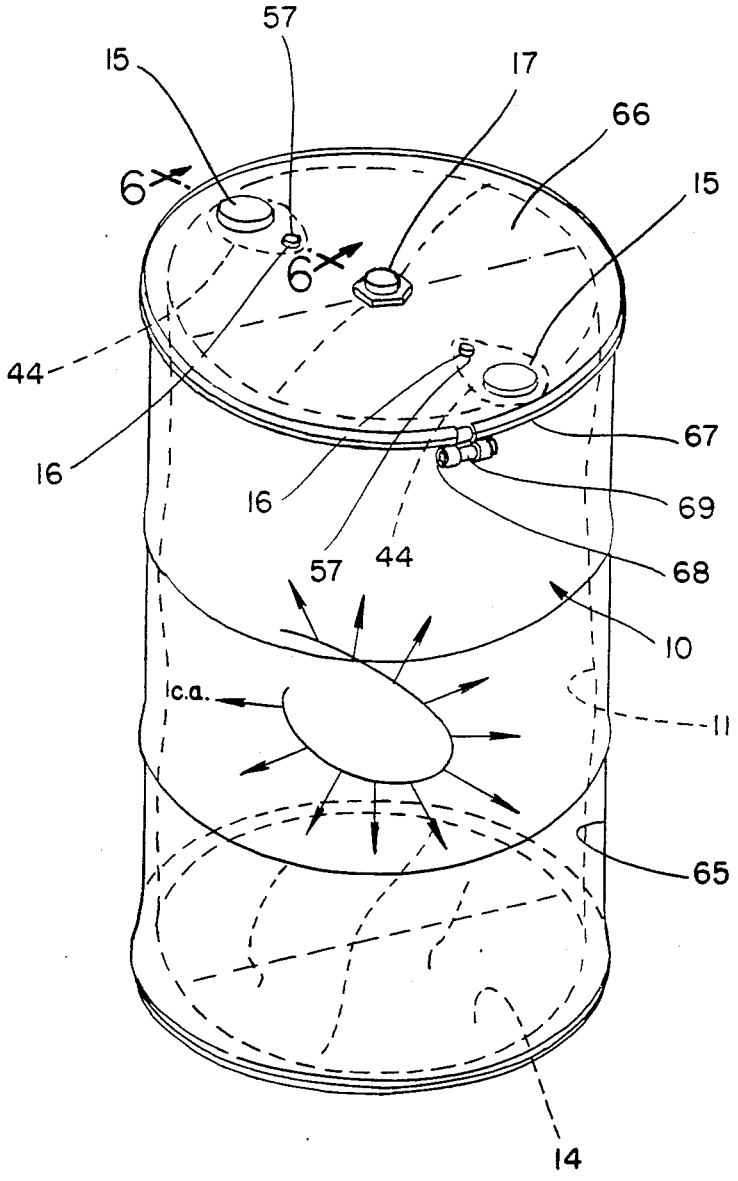
FIG. 5 is a perspective view of a second embodiment of a receptacle with a liner therein.

FIG. 5 shows a second embodiment in which like parts have been given like reference numerals, the distinction of the embodiment of FIG. 5 being that an alternatvie configuration is provided for attachment of the top end wall (66) to the side wall (65). Whereas the drum of FIG. 1 is known as a "closed head drum", the drum of FIG. 5 is known as an "open head drum" since the top end wall (66) is simply clamped into position, the periphery of the top end wall having a rolled over skirt which engages over a corresponding outwardly directed bead at the top end of the side wall (65); a clamping ring (67) is fitted over the assembly and tightened by means of a nut (68) and bolt (69). It is best to locate some sealing material between the faces of the end wall (66) and side wall (65) which are to contact one another.

Assembly of the combination of the receptacle with the liner in both the described embodiments is similar in that the liner (11) is secured by snap-fitting the glands (44) through the respective openings in the top end wall for the drum, the glands being located so as to be within the drum when assembly is completed and then the top end wall with the attached liner is secured to the side wall of the drum. A screw-threaded plug is sealingly engaged in one of the glands and compressed air introduced through the other gland to expand the liner as generally indicated in FIGS. 1 and 5 by the arrows and the reference "c,a" referring to compressed air. FIGS. 1 and 5 show the liner just before complete expansion has occurred. Air from between the liner and the interior of the drum wall escapes through the opening (17) as the liner is expanded and when the liner has been pressed into intimate contact with the interior walls of the drum, a closure plug is screw-threadably engaged in the opening (17) to prevent return of air.

The liner may now be filled with contents and upon subsequent discharge of the contents a partial vacuum is maintained so that the liner is retained in substantially intimate contact with the interior surfaces of the drum.

The invention can be applied to embodiments in which the liner is adapted to hold contents within a large range, for example 10 liters to 300 liters. The material chosen for the glands and the liner is selected to suit the material to be packaged, polyethylene being readily available, useful and relatively cheap material for many purposes but may be substituted where required to suit specific products.

I claim:

1. An improved lined receptacle comprising, in combination:

a rigid, enclosed container having a cylindrical side wall, an attached bottom wall, and a top wall, said top wall having an interior side and an exterior side, said top wall defining two opposed pairs of spaced openings, each of said two opposed pairs including a first gland opening and a second gland opening, said top wall further having first and second skirts extending outwardly from said exterior side and enclosing said first and second gland openings, respectively;

a flexible liner adapted to substantially fill said rigid, enclosed container, said liner comprising first and second opposed, overlying, flexible, rectangularly shaped panels of a film material, said panels sealed at the edges thereof and also sealed across the corners to define a bag enclosure;

first and second gland members sealingly attached to said flexible liner, one of said gland members being attached to the first panel and the other gland member being attached to the second panel, said gland members being separated by a seal along an edge of the panels and in an opposed relationship;

said gland members adapted to engage said two opposed pairs of spaced openings by projecting through the first and second gland openings, respectively, whereby said flexible liner is draped between said two opposed pairs of openings along said interior side of said top wall so as to facilitate filling and draining of said improved receptacle;

each of said first and second gland members including a base sealed to said flexible liner, a spigot extending from said base opposite said flexible liner, and a spout extending from said base opposite said flexible liner;

said spigot of each gland member having a spigot head and a spigot neck so as to snap fit into said first gland opening from said interior side of said top wall and outwardly directed, said first skirt engaging said spigot neck and abutting said spigot head;

said spout of each gland member having a spout head and a spout neck so as to snap fit into said second gland opening from said interior side of said top wall and outwardly directed, said second skirt engaging said spout neck and abutting said spout head, each of said spigots defining means of maintaining a gland member and attached liner in a torque resisting position with the sealed edge of the liner maintained intermediate the gland members and supported between the gland members;

said spout and said base providing a fluid passage between the interior of said flexible liner and said exterior side of said top wall;

seal means for selectively closing said fluid passage; and release vent means in said top wall for selectively relieving pressure between said rigid, enclosed container and said flexible liner, said vent means centrally located between the pairs of gland openings.

2. An improved receptacle as claimed in claim 1 wherein said spout is internally threaded and said seal means is an externally threaded cap.

3. An improved receptacle as claimed in claim 1 further comprising an O-ring seal about said spout and interposed said base of said gland member and said top wall of said rigid, enclosed container.

* * * * *